United States Patent [19]

Hughes

[11] 4,397,278

[45] Aug. 9, 1983

[54] AIR FUEL RATIO CONTROL USING TIME-AVERAGED ERROR SIGNAL

[75] Inventor: Joseph L. Hughes, Belleville, Mich.

[73] Assignee: Ford Motor Company, Dearborn, Mich.

[21] Appl. No.: 250,983

[22] Filed: Apr. 3, 1981

[51] Int. Cl.[3] ..... F02D 33/00

[52] U.S. Cl. ..... 123/440; 123/489

[58] Field of Search ..... 123/440, 489; 60/276, 60/285

[56] References Cited

U.S. PATENT DOCUMENTS

| | | | |
|---|---|---|---|
| 3,782,347 | 1/1974 | Schmidt et al. | 123/440 |
| 3,831,564 | 8/1974 | Schmidt et al. | 123/440 |
| 3,895,611 | 7/1975 | Endo et al. | 123/489 |
| 3,900,012 | 8/1975 | Wahl et al. | 123/440 |
| 3,998,189 | 12/1976 | Aoki | 123/440 |
| 4,111,171 | 9/1978 | Aono et al. | 123/440 |
| 4,122,811 | 10/1978 | Bowler et al. | 60/285 |
| 4,224,910 | 9/1980 | O'Brien | 123/440 |
| 4,307,694 | 12/1981 | Jacobs | 123/440 |
| 4,338,900 | 7/1982 | Dilger et al. | 123/489 |

*Primary Examiner*—Charles J. Myhre
*Assistant Examiner*—Andrew M. Dolinar
*Attorney, Agent, or Firm*—Peter Abolins; Clifford L. Sadler

[57] ABSTRACT

This specification discloses an apparatus and method for controlling the air fuel ratio in an internal combustion engine in response to a feedback signal from an exhaust gas oxygen sensor. The sensor output signal is sampled periodically. Control of the air fuel ratio utilizes time based averaging of the oxygen sensor signal to generate an error signal which is proportional to the difference between the actual and desired air fuel ratio.

1 Claim, 4 Drawing Figures

PROGRAMMABLE PARAMETERS

FCR = FRACTION OF TIME RICH (IE,%/100), BIASING CONSTANT
$K_G$ = GAIN CONSTANT
τ = TIME CONSTANT OF EI FILTER
= KTAU · CLOCK TIME

PROGRAMMABLE PARAMETERS

FCR = FRACTION OF TIME RICH (IE, %/100), BIASING CONSTANT $K_G$ = GAIN CONSTANT $\tau$ = TIME CONSTANT OF EI FILTER

= KTAU · CLOCK TIME

AIR FUEL RATIO CONTROL USING TIME-AVERAGED ERROR SIGNAL

BACKGROUND OF THE INVENTION (1) Field of the Invention

This invention relates to engine fuel control systems which incorporate an air/fuel ratio feedback control.

(2) Prior Art

Various fuel control systems are known in the prior art in which the quantity of fuel fed to the engine is controlled by sensors in the exhaust gas which give an indication of the air fuel ratio. Nevertheless, it remains extremely difficult to compensate for the ever changing operating conditions of the engine, the variations among different engines and so on as to always operate the engine with a predetermined air fuel ratio. This drawback may become critical when the engine is equipped with a catalytic converter for reducing undesirable components of the exhaust gases.

A widely used technique to control the air fuel ratio in stoichiometric feedback controlled fuel metering systems is limit cycle integral control. In this technique, there is a constant movement of a fuel metering component in a direction that always tends to counter the instantaneous air fuel ratio indication given by a typical two state exhaust gas oxygen (EGO) sensor. For example, every time an EGO sensor indicates a switch from a rich to a lean air fuel ratio mode of operation, the direction of motion of a typical carburetor's metering rod reverses to create a richer air fuel ratio condition until the sensor indicates a change from a lean to rich air fuel ratio condition. Then, the direction of motion of the metering rod is reversed again this time to achieve a leaner air fuel ratio condition.

Referring to FIGS. 1*a* and 1*b*, step like changes in the sensor output voltage initiate ramp like changes in the actuator control voltage. When using the limit cycle integral control, the desired air fuel ratio can only be attained on an average basis since the actual air fuel ratio is made to fluctuate in a controlled manner about the average value. The limit cycle integral control system can be characterized as a two state controller with the mode of operation being either rich or lean. The average deviation from the desired value is a strong function of a parameter called engine transport delay time, tau. This is defined as the time it takes for a change in air fuel ratio, implemented at the fuel metering mechanism, to be recognized at the EGO sensor, after the change has taken place.

The engine transport delay time is a function of the fuel metering system's design, engine speed, air flow, and EGO sensor characteristics. Because of this delay time, a control system using a limit cycle technique always varies the air fuel ratio about a mean value in a cyclical manner, a rich air fuel ratio time regime typically followed by a lean air fuel ratio time regime. The shorter the transport delay time is, the higher will be the frequency of rich to lean and lean to rich air fuel ratio fluctuation and the smaller will be the amplitudes of the air fuel ratio overshoots. It can be appreciated that a system with no engine transport delay time is the ideal. These are some of the problems this invention overcomes.

SUMMARY OF THE INVENTION

This invention recognizes that the use of an error signal which is proportional to the distance away from the optimum air fuel ratio can improve the operation of a feedback controlled fuel flow system in an internal combustion engine. The error signal utilizes time based averaging of the oxygen sensor signal.

An air fuel ratio feedback fuel control system for an internal combustion engine includes a sensing means for sensing the quantity of oxygen in the exhaust emissions of the engine at a given repetition rate. The control means is coupled to the sensing means for controlling the rate of supply of fuel to the engine in accordance with at least one of the parameters sensed by the sensing means. The control means also responds to the sampled sensor output so that there is generated a time based averaging of the indications of the exhaust gas oxygen sensor to provide correction proportional to the difference between the actual and the desired air fuel ratio. Because the error signal is proportional to the deviation from the desired air fuel ratio, rather than just rich or lean of stoichiometry, there is a faster correction stepping rate when the air fuel ratio is far from the desired value, and a slower rate when the air fuel ratio is closer. Further, there is an advantageous reduction in overreaction to transient conditions.

DETAILED DESCRIPTION OF THE INVENTION

In accordance with an embodiment of this invention, an exhaust gas oxygen (EGO) sensor output signal is sampled and the fuel metering system is adjusted to produce a stoichiometric air fuel ratio calibration. Specifically, the signal causing a rate of change in the air fuel ratio is a function of the difference between the desired and the actual air fuel ratio and also a function of the time that the actual air fuel ratio has been positioned on a given side of stoichiometry, that is rich or lean.

Figure 3:
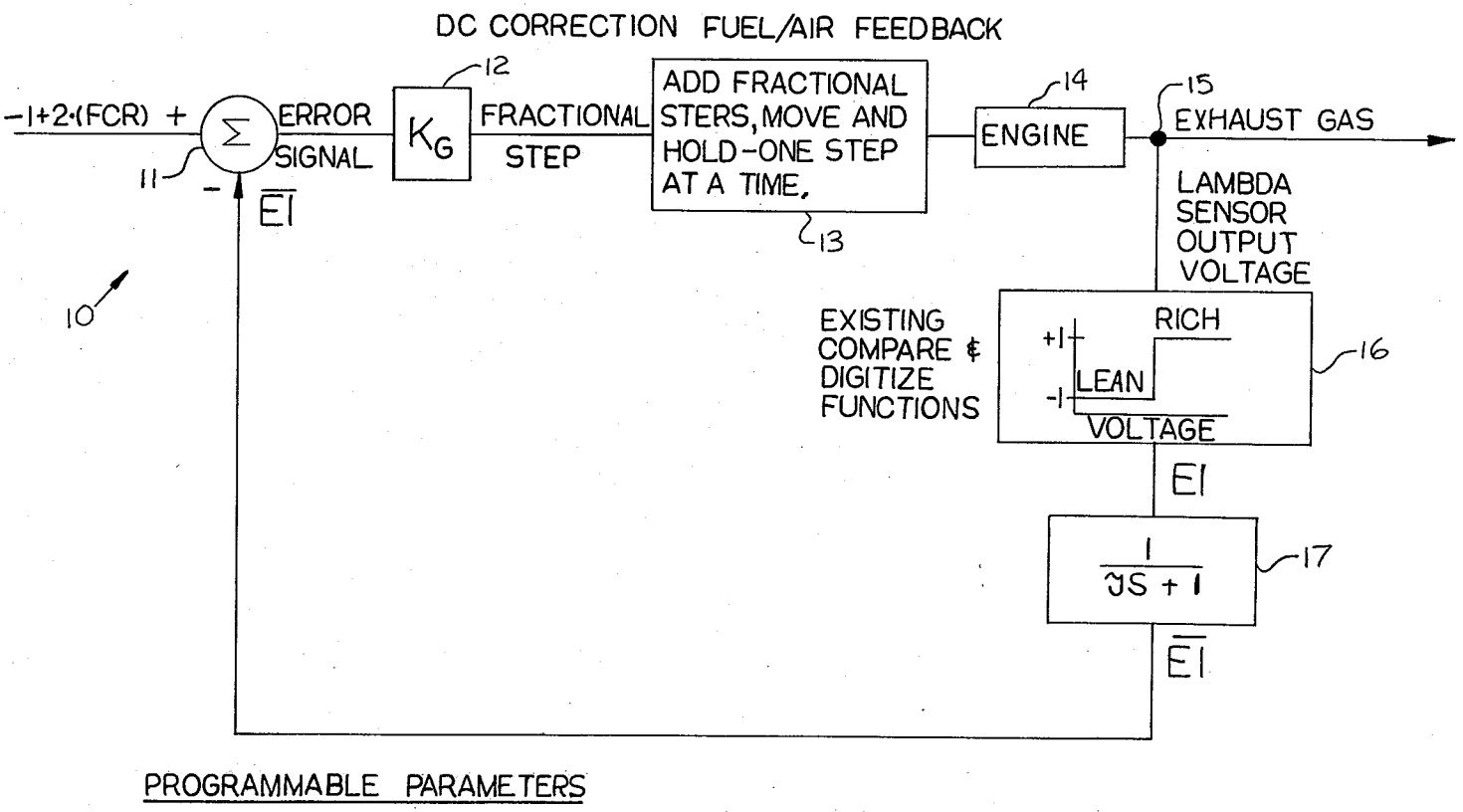
FIG. 3 is a partly schematic and partly block diagram of the connection of an engine fuel control system which incorporates an air fuel ratio feedback control in accordance with an embodiment of this invention.

Referring to FIG. 3, a block diagram of an embodiment of this invention shows that a feedback system 10 includes a summer 11 comparing the desired fraction of the time for the fuel system to operate rich of stoichiometry with the processed feedback signal or actual fraction of time operating rich. An amplifier 12 receives an error signal from summer 11. An accumulator 13 receives a fractional step from amplifier 12. Accumulator 13 adds fractional steps and moves and holds the information, one step at a time. An engine 14 receives a fuel command control signal from accumulator 13. Exhaust gas from engine 14 passes by an exhaust gas oxygen sensor 15 which produces an electrical output voltage for use by a comparator 16. Comparator 16 determines whether the signal received from sensor 15 is rich or lean of stoichiometry. The output of comparator 16 is applied to an average processor 17 to obtain a rolling average of the output of comparator 16. The rolling average from average processor 17 is applied to summer 11.

In operation, the error signal is a function of the deviation from a set point or desired point, rather than just rich or lean of stoichiometry. This means that there is a faster correction stepping rate when the air fuel ratio is far from the desired value, and a slower rate when the air fuel ratio is closer to the desired value. As a result of such a scheme, overreaction to transient conditions is reduced. Further, there is more range of asymmetric biasing than with limit cycle control. Such a system allows feedback at idle to be a significant amount richer than stoichiometry. This can improve emission control since the use of biasing with a dither cycle is limited by excessive amplitude of air fuel oscillation. Further advantages include that relative shifts of the air fuel ratio should be more accurate because the starting point is more stable. Additionally, there is significant potential for reduction of the amount of computer memory needed in comparison with other engine control strategies since the limit cycle algorithm can be removed.

In testing, an optimized fixed control position has given results equal to or better than any limit cycle tested. However, even with a fixed control position, there is considerable switching of the air fuel ratio sensor due to cylinder discrete distribution and exhaust pulsing. This amount of switching decreases as the air fuel ratio moves away from stoichiometry. The percent of time the air fuel ratio sensor indicates rich is related to the distance from stoichiometry at which the engine is running.

Referring to FIG. 3, the variable El already exists in known engine control strategies and represents the instantaneous indication of a rich or lean air fuel ratio. As shown in FIG. 2*a*, it can have a value of either +1 (rich) or −1 (lean). The operation of averager 17 to obtain a rolling average function produces an $\overline{El}$, a measure of time the sensor is rich versus lean (FIG. 2*d*). The LaPlace transform of averager 17 is $(1/\tau_s+1)$, wherein $\tau$ is the time constant of averager 17, the El filter. The filter time constant, KTAU, is related to $\tau$ as a function of each computer program cycle and determines the amount of smoothing by the filter. In the steady state, if the sensor is rich 50% of the time, the value of $\overline{El}$ is equal to zero. The value of $\overline{El}$ can then be compared to the other input to summer 11, 2 FCR−1, where FCR is a biasing constant (fraction rich) ranging from zero to one. A value for FCR when 50% of time is spent in rich operation is 0.5 and would be expected value when operation is at stoichiometry. The signal from summer 11 is multiplied by a gain constant $K_g$ to yield a correctional value which typically will be much less than one step. These values which are computed every computer program cycle will be integrated by adding to (or subtracting from) a storage register. Since the system can only correct in single step increments, this register will send out unit signals, simultaneously subtracting the unit from its value.

In equation form, the steps or fraction of a step per computer program cycle is equal to $$K_g((2FCR-1)-\overline{El}) \tag{1}$$

The rolling average filter for El is equal to $$\overline{El}_{new} = \frac{1}{1+KTAU}(El) + \frac{KTAU}{1+KTAU}(\overline{El}_{old}) \tag{2}$$

where KTAU is the number of iteration periods in the desired time constant $\tau$, i.e.,:

$$KTAU = \frac{\tau}{\text{iteration time period}}$$

This should be iterated every computer program cycle.

If a nonstoichiometric air fuel ratio calibration is desired, the value of FCR can be other than 0.5. Another way to create asymmetric biasing with this algorithm is to use a different value of $K_g$, depending on the sign of the error signal from summer 11. Still another way to create asymmetric biasing is to have separate input values of FCR depending on whether the instantaneous EGO input is rich or lean. In addition, a technique in accordance with an embodiment of this invention could show added benefit of operating engines at higher catalyst efficiencies by approximating a perfect open loop calibration more closely.

Figure 4:
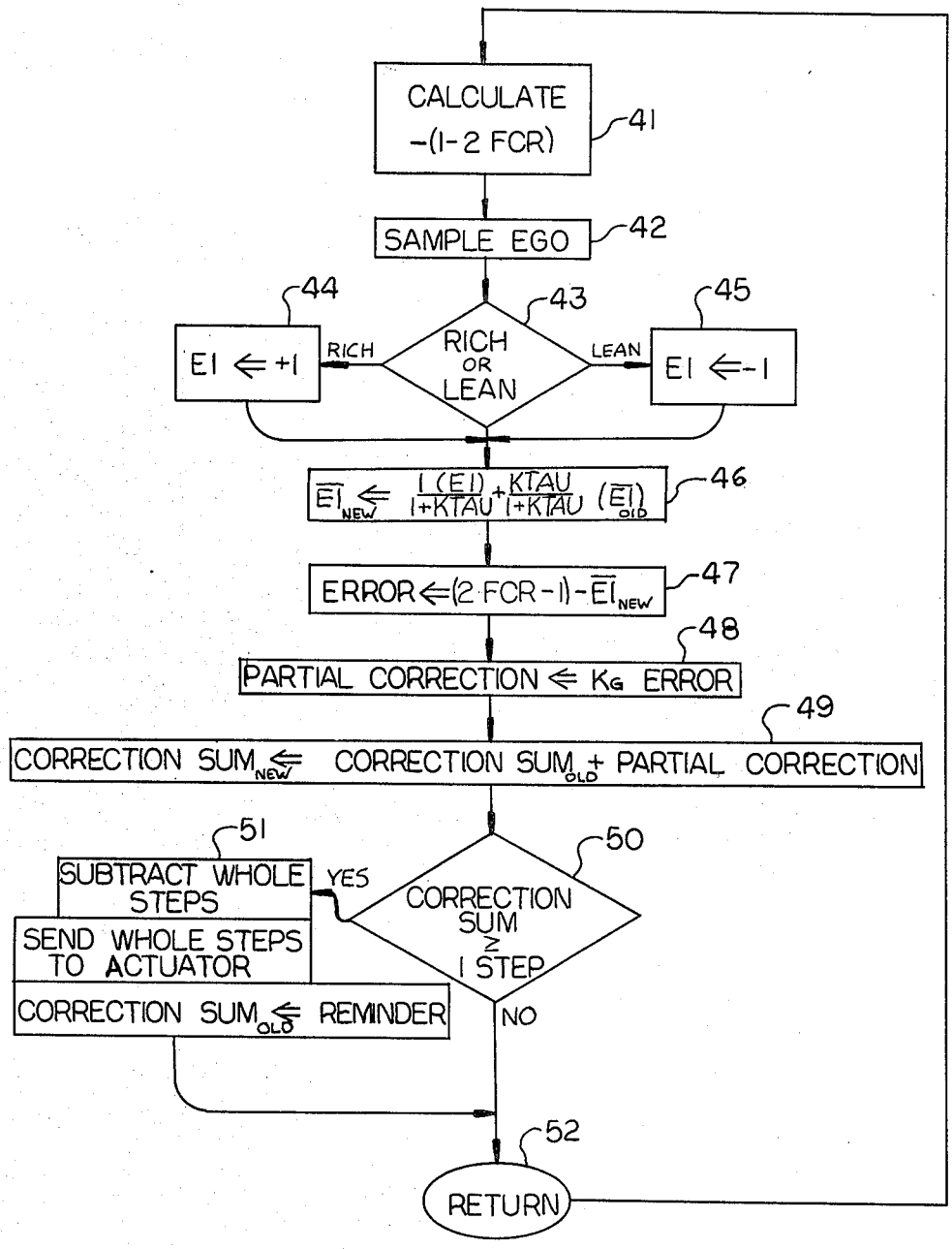
FIG. 4 is a logic flow diagram of an air fuel ratio feedback control in accordance with an embodiment of this invention.

Referring to FIG. 4, block 41 indicates a calculation of the quantity (2 FCR−1). Block 41 is coupled to a block 42 wherein the exhaust gas oxygen sensor samples the oxygen content of the exhaust gas. The output of block 42 is coupled to a decision block 43 which makes a determination whether the detected sample in block 42 is rich or lean of the desired amount representative of the desired air fuel ratio. If the indication is too rich then an output is applied to a block 44 which loads the quantity El with a +1. The arrow is used in FIG. 4 instead of an equal sign as being more descriptive of the actual process in this logic flow diagram and indicating the quantity on the left as being loaded with the quantity on the right of the arrow. If the indication in block 43 is lean then an output is applied to a block 45 wherein a quantity minus 1 is loaded into El. The outputs of both block 44 and 45 are coupled to a block 46 wherein a new El is calculated in accordance with the indicated formula. The output of block 46 is coupled to a block 47 wherein an error is computed in accordance with the indicated formula. The output of block 47 is coupled to a block 48 wherein the result of multiplying the gain constant, $K_g$ by the error is loaded into a partial correction function. The output of block 48 is coupled to a block 49 wherein a new correction sum is determined as the sum of the old correction sum and the partial correction. The output of block 49 is coupled a decision block 50 wherein the absolute value of the new correction sum is compared to a single step. If the absolute value of the correction sum is greater than one step then an output is applied to a block 51. Block 51 initiates the action of subtracting old steps, sending old steps to the actuator and loading the remainder in the old correction sum. The output of block 51 is coupled to a block 52 which then returns back to block 41. If the decision in block 50 indicates that the absolute value of the new correction sum is less than one step then the output from block 50 is supplied directly to block 52 and the logic sequence reiterated.

Figure 1:
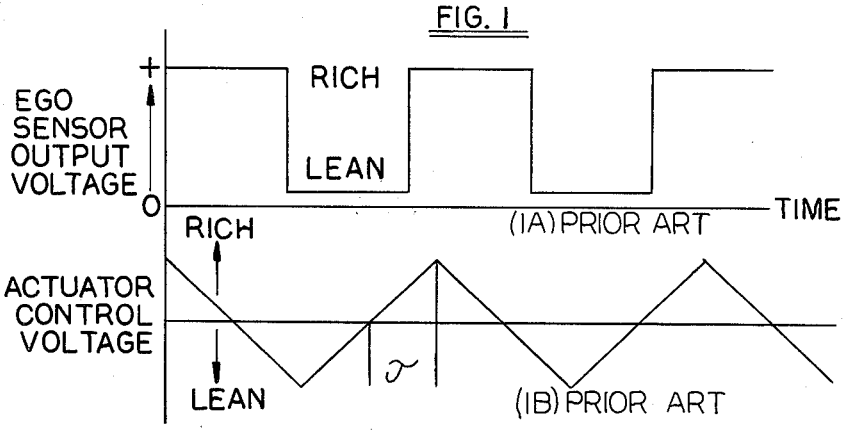
FIG. 1*a* is a graphical representation of the EGO sensor output voltage with respect to time in accordance with a prior art limit cycle controlled technique.
FIG. 1*b* is a graphical representation of the actuator control voltage with respect to time corresponding to the prior art sensor output voltage of FIG. 1*a;*
Figure 2:
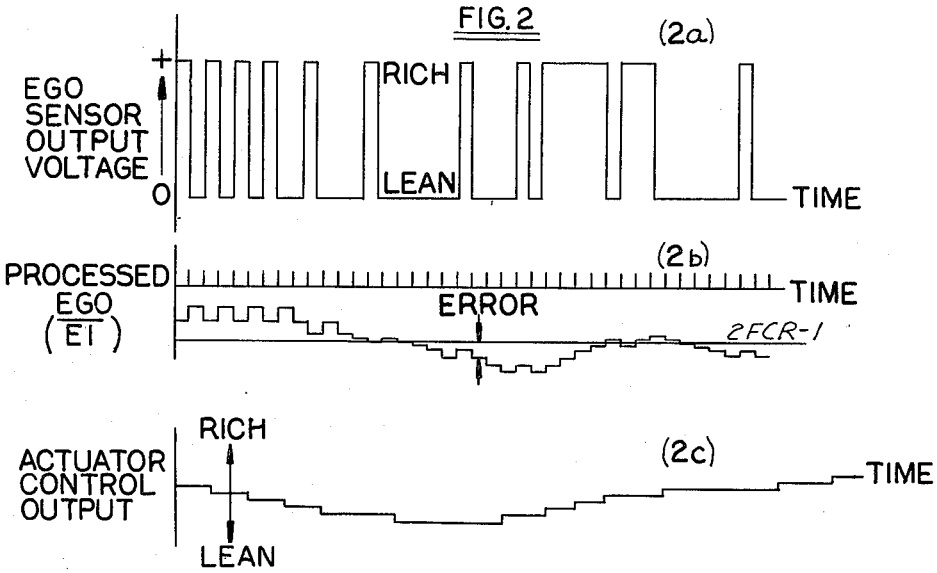
FIG. 2*a* is a graphical representation of the EGO sensor output voltage with respect to time as shown for prior art except that time covered is much greater.
FIG. 2*b* are graphical representations of the processed EGO signal $\overline{EI}$ and the error signal with respect to time.
FIG. 2*c* is a graphical representation of the actuator control output with respect to time.
FIG. 2*d* is a graphical representation for steady state conditions of the processed EGO signal El with respect to the percent of time the EGO sensor indicates a rich condition.
Figure 2:
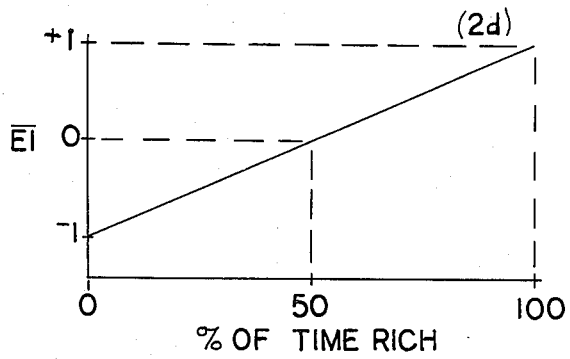

Referring to FIG. 2, a graphical representation shows the exhaust gas sensor oxygen output voltage versus time. The plus level represents the indication of a rich air fuel ratio and the zero level represents an indication of a lean air fuel ratio. FIG. 2*b* represents a time scale with decision time indicated at equally spaced intervals as well as the output of summer 11 is represented as an error and is the difference between one input to the summer, 2 FCR − 1, represented as a horizontal line and the $\overline{\text{El}}$ signal which is represented as a plurality of steps.

Referring to FIG. 2*c*, the horizontal axis is time with the actuator control output indicated in the vertical direction. The output is a series of steps which tends to counteract the error shown in FIG. 2*b*. That is, if the error is positioned above the horizontal line indicated by 2 FCR − 1 the actuator control output steps in the downward or lean direction. In contrast, if the error is positioned below the 2 FCR − 1 line then the actuator control output steps in the upward or rich direction to reduce the magnitude of the error.

Various modifications and variations will no doubt occur to those skilled in the art to which this invention pertains. For example, the particular number of samples or frequency of samples may be varied from that disclosed herein. These and all other variations which basically rely on the teachings through which this disclosure has advanced the art are properly considered within the scope of this invention.

I claim:

1. An air fuel ratio feedback type fuel supply system for an internal combustion engine comprising:

sensing means for sensing the quantity of oxygen within the exhaust emission of the engine at a given repetition rate and for providing an output indicating whether the air/fuel ratio is rich or lean of stoichiometry;

control means coupled to receive the output of said sensing means for controlling the rate of supply of fuel to the engine as a function of the quantity of oxygen sensed by said sensing means, said control means responding to said output so that the rate of making the air fuel ratio richer is a function of a first fraction of time a rich air fuel ratio has been indicated by said sensing means and the rate of making the air fuel ratio leaner is a function of a second fraction of time a rich air fuel ratio has been indicated by said sensing means, and said control means not changing the rate of supply of fuel when the fraction of time a rich air fuel ratio has been indicated falls between the first fraction and the second fraction of time;

said control means including a biasing means for comparing the fraction of time a rich air fuel ratio occurs to the fraction of time a rich air fuel ratio is desired, and for generating a difference amount which is processed to yield a correction signal for adjusting the rate of supply of fuel to the engine;

said biasing means having an output means for supplying a discrete, step correction signal; and said control means being adapted to change the air fuel ratio in accordance with the formula $$\overline{El}_{new} = \frac{1\,(El)}{1 + KTAU} + \frac{KTAU}{1 + KTAU}\,(\overline{El}_{old})$$

wherein El is an expression of the sensing means output indicating a rich or lean condition, $\overline{El}_{new}$ is a rolling average based upon $El_{old}$, the previous rolling average, KTAU is a filter time constant indicating the transient responsiveness of said control means.

* * * * *